US007118204B2

(12) United States Patent
Hatasa et al.

(10) Patent No.: US 7,118,204 B2
(45) Date of Patent: Oct. 10, 2006

(54) LIQUID CONTAINER HAVING HOLLOW TUBULAR MEMBER FOR LIQUID AGITATION

(75) Inventors: Nobuyuki Hatasa, Kanagawa (JP); Hajime Yamamoto, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 198 days.

(21) Appl. No.: 10/718,605

(22) Filed: Nov. 24, 2003

(65) Prior Publication Data

US 2004/0100540 A1 May 27, 2004

(30) Foreign Application Priority Data

Nov. 27, 2002 (JP) ..... 2002-344507

(51) Int. Cl.
*B41J 2/175* (2006.01)

(52) U.S. Cl. ..... 347/86; 347/85

(58) Field of Classification Search ..... 347/86, 347/85

See application file for complete search history.

(56) References Cited

U.S. PATENT DOCUMENTS

| | | | | |
|---|---|---|---|---|
| 4,159,790 | A * | 7/1979 | Bailey | 222/211 |
| 5,742,311 | A * | 4/1998 | Koitabashi et al. | 347/86 |
| 6,270,206 | B1 | 8/2001 | Shimizu et al. | 347/86 |
| 6,382,783 | B1 | 5/2002 | Hayashi et al. | 347/85 |
| 6,402,308 | B1 | 6/2002 | Hattori et al. | 347/86 |
| 6,422,674 | B1 | 7/2002 | Hinami et al. | 347/7 |
| 6,450,631 | B1 | 9/2002 | Hayashi et al. | 347/86 |
| 6,471,343 | B1 | 10/2002 | Shimizu et al. | 347/85 |
| 6,505,923 | B1 | 1/2003 | Yamamoto et al. | 347/85 |
| 6,511,167 | B1 | 1/2003 | Kitabatake et al. | 347/86 |
| 6,530,654 | B1 | 3/2003 | Kitabatake et al. | 347/86 |
| 6,543,886 | B1 | 4/2003 | Hattori et al. | 347/85 |
| 6,550,898 | B1 | 4/2003 | Hayashi et al. | 347/85 |
| 6,554,411 | B1 | 4/2003 | Hatasa et al. | 347/86 |
| 6,598,963 | B1 | 7/2003 | Yamamoto et al. | 347/85 |
| 6,702,427 | B1 | 3/2004 | Shimizu et al. | 347/86 |
| 6,709,092 | B1 | 3/2004 | Hayashi et al. | 347/86 |
| 6,712,458 | B1 | 3/2004 | Hatsa et al. | 347/86 |
| 6,742,857 | B1 | 6/2004 | Koshikawa et al. | 347/19 |
| 6,805,434 | B1 | 10/2004 | Hayashi et al. | 347/85 |
| 6,824,258 | B1 | 11/2004 | Yamamoto et al. | 347/85 |
| 2001/0026306 | A1 * | 10/2001 | Yamazaki et al. | 347/86 |
| 2003/0043241 | A1 | 3/2003 | Hattori et al. | 347/86 |
| 2003/0085958 | A1 * | 5/2003 | Furukawa | 347/63 |

(Continued)

FOREIGN PATENT DOCUMENTS

| | | |
|---|---|---|
| JP | 2001-270131 | 10/2001 |

(Continued)

*Primary Examiner*—Stephen Meier
*Assistant Examiner*—Laura E Martin
(74) *Attorney, Agent, or Firm*—Fitzpatrick, Cella, Harper & Scinto

(57) ABSTRACT

A liquid container of this invention comprises: a hollow tubular member whose one end installed in the liquid container is connected to the supply port; liquid supply holes formed in the tubular member; and an air introducing port provided at a bottom of the tubular member to introduce air into the tubular member; wherein the liquid in the liquid container is introduced into the tubular member through the liquid supply holes and the liquid thus introduced is supplied from the supply port to another device. As air is introduced from the air introducing port into the tubular member and rises as a bubble in the tubular member, a convection is generated to agitate the liquid inside the tubular member. This agitating action alleviates concentration variations in the liquid in the tubular member.

6 Claims, 13 Drawing Sheets

U.S. PATENT DOCUMENTS

| | | | | |
|---|---|---|---|---|
| 2003/0085968 | A1* | 5/2003 | Shimizu et al. | 347/86 |
| 2003/0234844 | A1 | 12/2003 | Yamamoto et al. | 347/19 |
| 2004/0160756 | A1 | 8/2004 | Furuya et al. | 362/27 |

FOREIGN PATENT DOCUMENTS

| | | |
|---|---|---|
| JP | 2001-293880 | 10/2001 |

* cited by examiner

LIQUID CONTAINER HAVING HOLLOW TUBULAR MEMBER FOR LIQUID AGITATION

This application claims priority from Japanese Patent Application No. 2002-344507 filed Nov. 27, 2002, which is incorporated hereinto by reference.

BACKGROUND OF THE INVENTION

1. Field of the Invention

The present invention relates to a liquid container for storing a liquid such as ink, used to supply the ink to a print head of an ink jet printing apparatus. More specifically, the present invention relates to a liquid container for storing ink containing pigment as a colorant.

2. Description of the Related Art

The ink jet printing apparatus forms an image on a print medium by ejecting ink from a plurality of nozzles in a print head onto the print medium. In such ink jet printing apparatus, there are two types of ink tank for installed supplying ink to the print head: an ink tank of relatively small capacity is adapted to be mounted on a carriage together with the print head, and an ink tank of relatively large capacity is adapted not to be mounted on the carriage but to supply ink through a supply member to the print head. The ink tank of relatively large capacity not mounted on the carriage is often removably connected to an end of an ink supply system that supplies ink to the print head. The conventional removable ink tank is known either to use in the ink tank with a member for generating a capillary force, such as a sponge, for holding ink or to directly store ink in a flexible bag or in a stiff case. In a wide format printer with a large ink consumption volume per print medium or in a network printer with a high operating efficiency, in particular, a large volume of ink is required. Hence, considering a reduction in an ink tank replacement frequency and an ink storage efficiency, an ink tank of the type that directly stores ink in the tank without using a member such as sponge has been desired.

In such an ink tank of directly storing ink, a dye ink capable of keeping an ink concentration uniformity at all times has been used. However, printed products using the dye ink have poor light, gas and water resistances. Therefore, the dye ink is not suited for print materials for outdoor display and for long-term storage. A pigment ink that uses pigment as a colorant, on the other hand, has excellent light, gas and water resistances, compared with the dye ink. However, since pigments are dispersed, not dissolved, in a solvent, they will precipitate in a static ink tank.

The small-capacity ink tank integrally formed with the print head and mounted on the carriage is vibrated by a scanning action of the carriage, which agitates the ink contained therein. Hence, the print head is supplied with the ink that has a pigment dispersed to produce a relatively uniform concentration. On the other hand, the large-capacity ink tank that is not mounted on the carriage is fixed stationary in a predetermined position from which it supplies ink, so that a phenomenon of the pigment precipitating in the tank cannot be ignored depending on a frequency of ink supply, an interval between ink supply operations and the number of print mediums to be printed.

For example, in an ink tank that is left standing for many hours, a pigment settles, there is a gradient of pigment particle concentration from a layer of excessively dark color at a tank bottom to a layer of excessively light color near a liquid surface in the ink tank, resulting in a significant ink concentration difference between the tank bottom and the liquid surface. If the ink tank has a construction in which ink is extracted from the bottom of the ink tank, an excessively high concentration ink is extracted first. Suppose a great deal of printing is performed in this condition. A comparison between a printed result obtained immediately after a start of the printing operation and a printed result obtained immediately before an end of the printing operation may indicate a recognizable color difference. This phenomenon is particularly remarkable with a color printing that forms an image with varying color densities.

To solve this problem, a tubular member having a plurality of holes on the circumference thereof is extended from an ink supply port of the ink tank into the interior of the ink tank so that ink is drawn out not only from portions near the ink supply port but also from many vertically spaced positions in the ink tank. The ink drawn out from these holes is temporarily stored in an ink holding portion, from which it is then supplied to the print head, thereby reducing concentration variations in the supplied ink (e.g., Japanese Patent Application Laid-open Nos. 2001-270131 and 2001-293880).

Such a conventional ink tank also has the following problem.

First, ink from a variety of layers of different concentrations in the ink tank flows into the tubular member through a plurality of holes and mixes in the tubular member and the ink holding portion to become uniform in concentration. However, even in the tubular member and the ink holding portion, pigment precipitation occurs and therefore ink concentration variations may result. To solve this problem, it may be conceived to draw out ink from the tubular member as by a pump and discard it outside. But this method wastes ink and is not an effective method.

Further, a low-concentration ink in the upper part of the ink tank, because it contains a smaller amount of pigment, is lighter than a high-concentration ink at the bottom of the tank. As described above, ink flows into the tubular member evenly from various layers in the ink tank. In the tubular member, however, a heavy ink that has flowed in through the holes into a lower part of the tubular member wall occupies a vertically lower space in the tubular member while a light ink that has flowed in through the holes in an upper part of the tubular member wall occupies a vertically higher space in the tubular member. It is therefore difficult for a vertical convection between the heavy ink and the light ink to be set in motion, leaving a possibility of the heavy and light inks not mixing uniformly as it is supplied to the print head.

SUMMARY OF THE INVENTION

An object of the present invention is to provide an ink tank for an ink using a pigment as a colorant, the ink tank being able to eliminate concentration variations in the ink being supplied so that there are no visible concentration variations on a printed image.

In other words, it is an object of the present invention to provide a liquid container which stores a liquid having a plurality of concentration layers in a static state and, when extracting the liquid from the container, eliminates concentration variations in the extracted liquid so that a liquid of a predetermined constant concentration can be supplied at all times.

The liquid container of this invention stores a liquid that forms a plurality of concentration layers in a static state and has a supply port to supply the liquid to another device. This liquid container is characterized by: a hollow tubular member whose one end installed in the liquid container is connected to the supply port; at least one liquid supply hole formed in the tubular member; and an air introducing port provided at a bottom of the tubular member to introduce air into the tubular member; wherein the liquid in the liquid container is introduced into the tubular member through the liquid supply hole and the liquid thus introduced is supplied from the supply port to another device.

In the above construction, air is introduced from the air introducing port into the tubular member and rises as a bubble in the tubular member, generating a convection in the liquid inside the tubular member and disturbing it. This alleviates concentration variations in the liquid in the tubular member, ensuring a supply of liquid of a constant concentration.

The above and other objects, effects, features and advantages of the present invention will become more apparent from the following description of embodiments thereof taken in conjunction with the accompanying drawings.

DETAILED DESCRIPTION OF PREFERRED EMBODIMENTS

Ink tanks presented as embodiments of this invention will be described as follows by referring to the accompanying drawings. The liquid container according to the present invention is not limited to these ink tanks but is also applicable to containers storing other liquids and having a mechanism for supplying the liquids to other devices.

Figure 1:
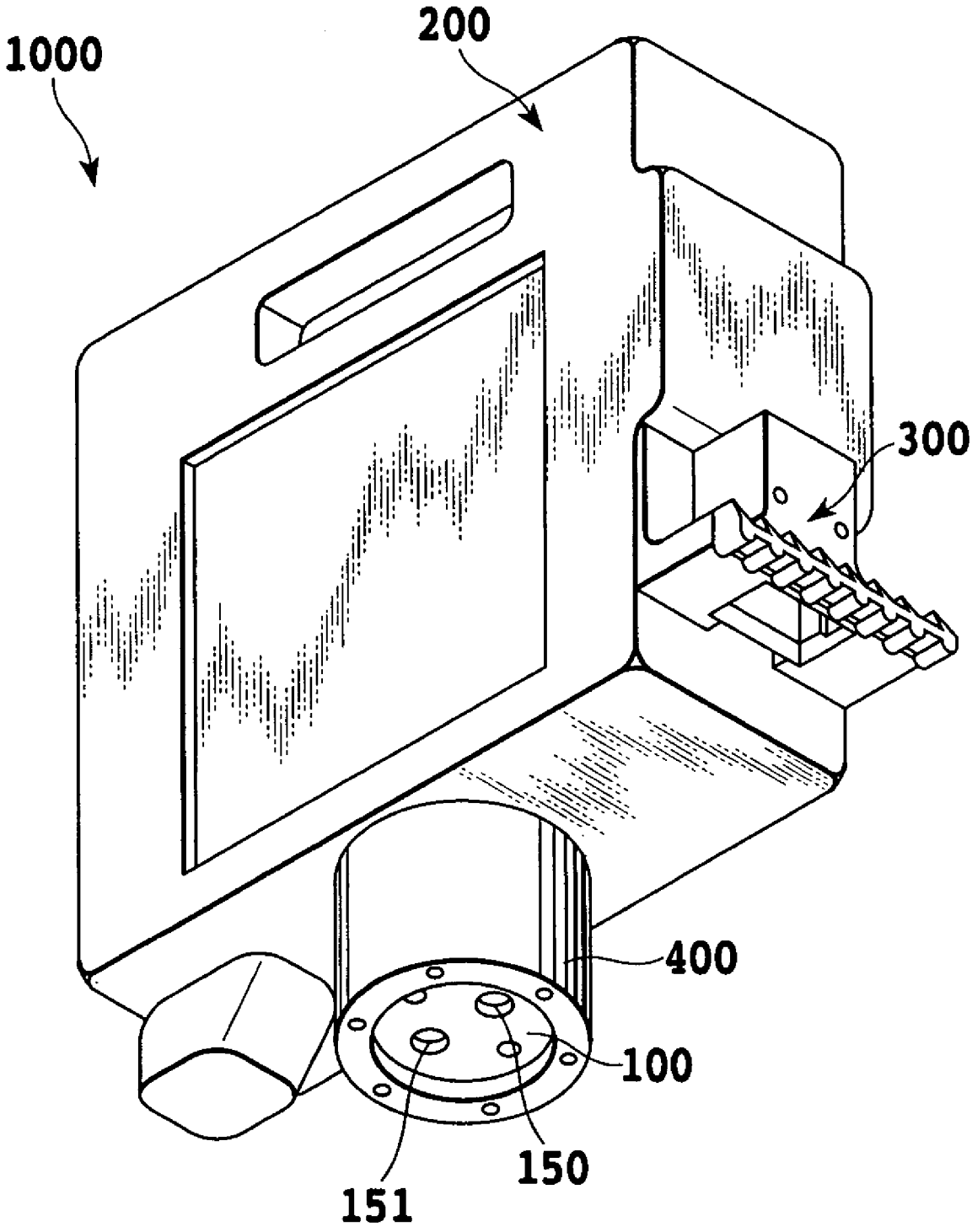
FIG. 1 is a perspective view showing an ink tank as one embodiment of the present invention.
Figure 2:
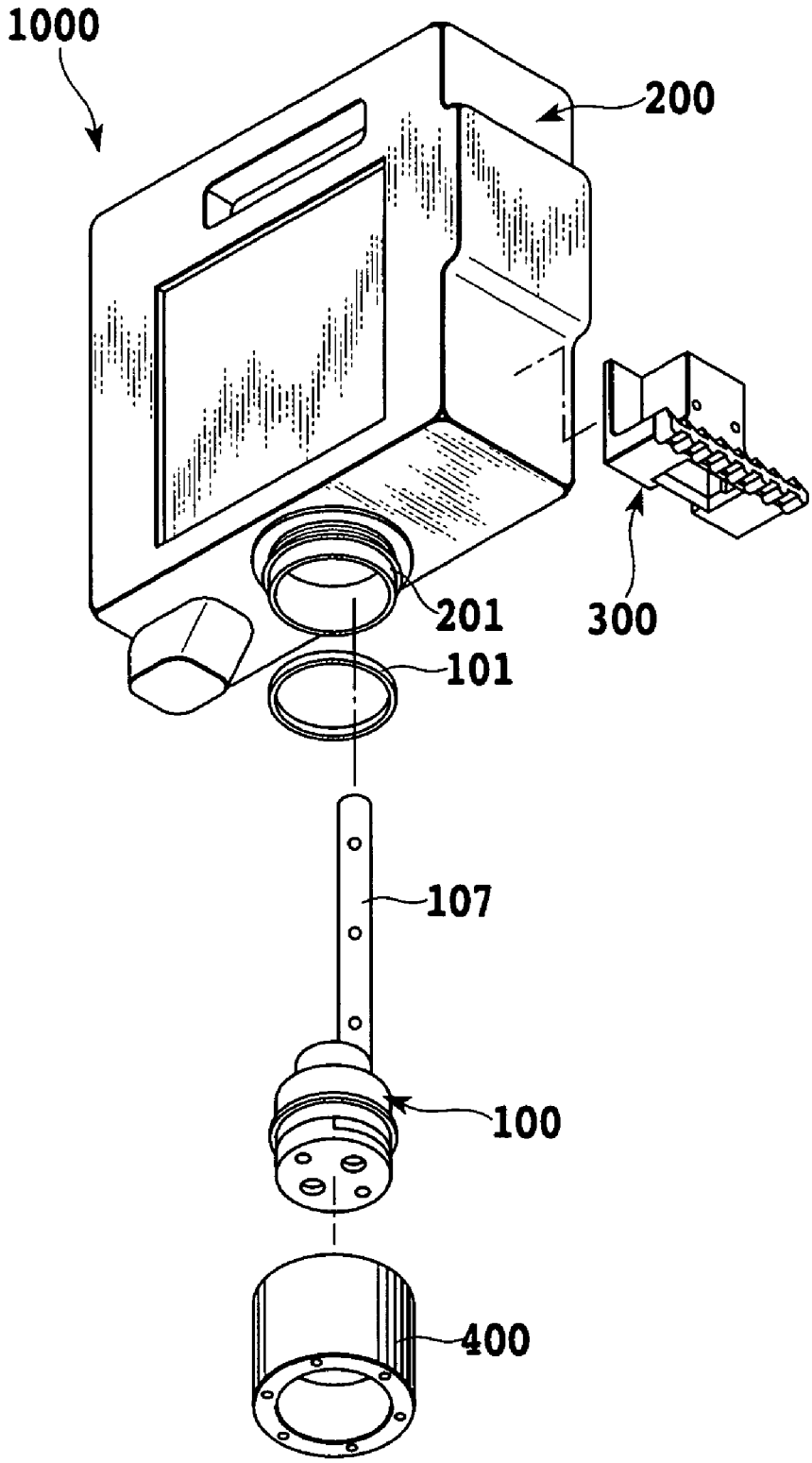
FIG. 2 is an exploded perspective view of the ink tank of FIG. 1.

FIG. 1 is a perspective view of an ink tank and FIG. 2 is a perspective view of FIG. 1.

An ink tank 1000 is removably mounted in a predetermined position on an ink jet printing apparatus to supply ink to a print head.

Designated 100 is a connection unit which, when the ink tank 1000 is mounted on the ink jet printing apparatus, connects the ink tank to an ink supply path on the ink jet printing apparatus side. The connection unit 100 is mounted, with its connection ports 150, 151 facing vertically down. That is, a side of the ink tank 1000 on which the connection unit 100 is provided forms a bottom portion.

As shown in FIG. 2, the ink tank 1000 has an ink storage portion 200, the connection unit 100 for drawing out ink from the ink storage portion 200, an information storage unit 300 for retrieving various information on the ink tank from the ink jet printing apparatus side, and a cap member 400 for fixing the connection unit 100.

The ink storage portion 200 is a hollow container formed of a plastic material by blow molding. The connection unit 100 has a tubular member (also referred to as an "ink agitation chamber") 107 stored in the ink storage portion 200. The tubular member 107 draws ink from the ink storage portion 200 through a plurality of holes formed in the tubular member 107. The tubular member 107 has its interior communicated to connection ports 105 so that ink taken into the tubular member 107 is fed to the connection ports 105.

The connection unit 100 is hermetically pressed and held to an opening 201 formed in the ink storage portion 200 through a seal member 101. Further, the cap member 400 is screwed over an external thread formed on an outer circumference of the opening 201 of the ink storage portion 200 with the connection unit 100 held therebetween.

The information storage unit 300 is secured to a side surface of the ink storage portion 200 as by ultrasonic welding.

Figure 3:
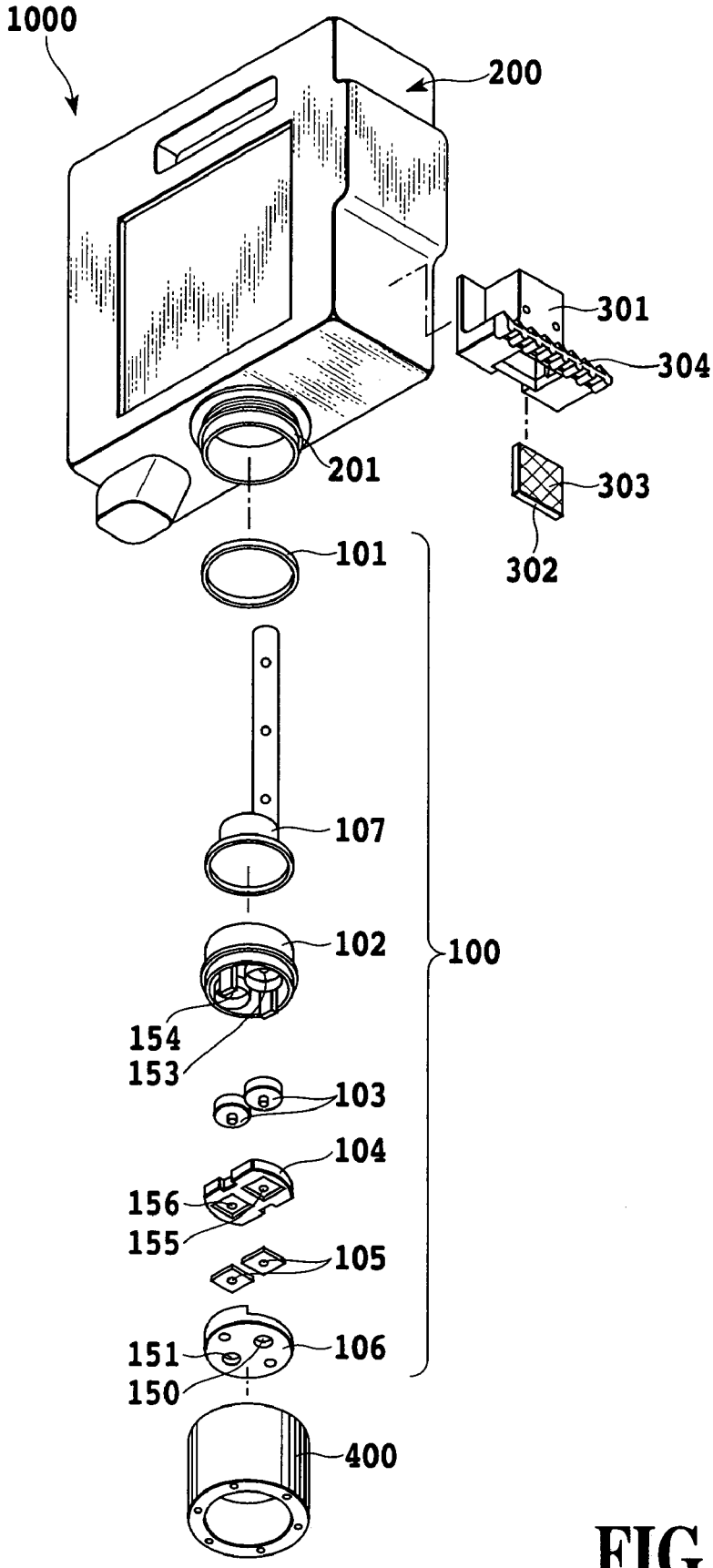
FIG. 3 is an exploded perspective view showing a connection unit of FIG. 2 in a further disassembled state.
Figure 4:
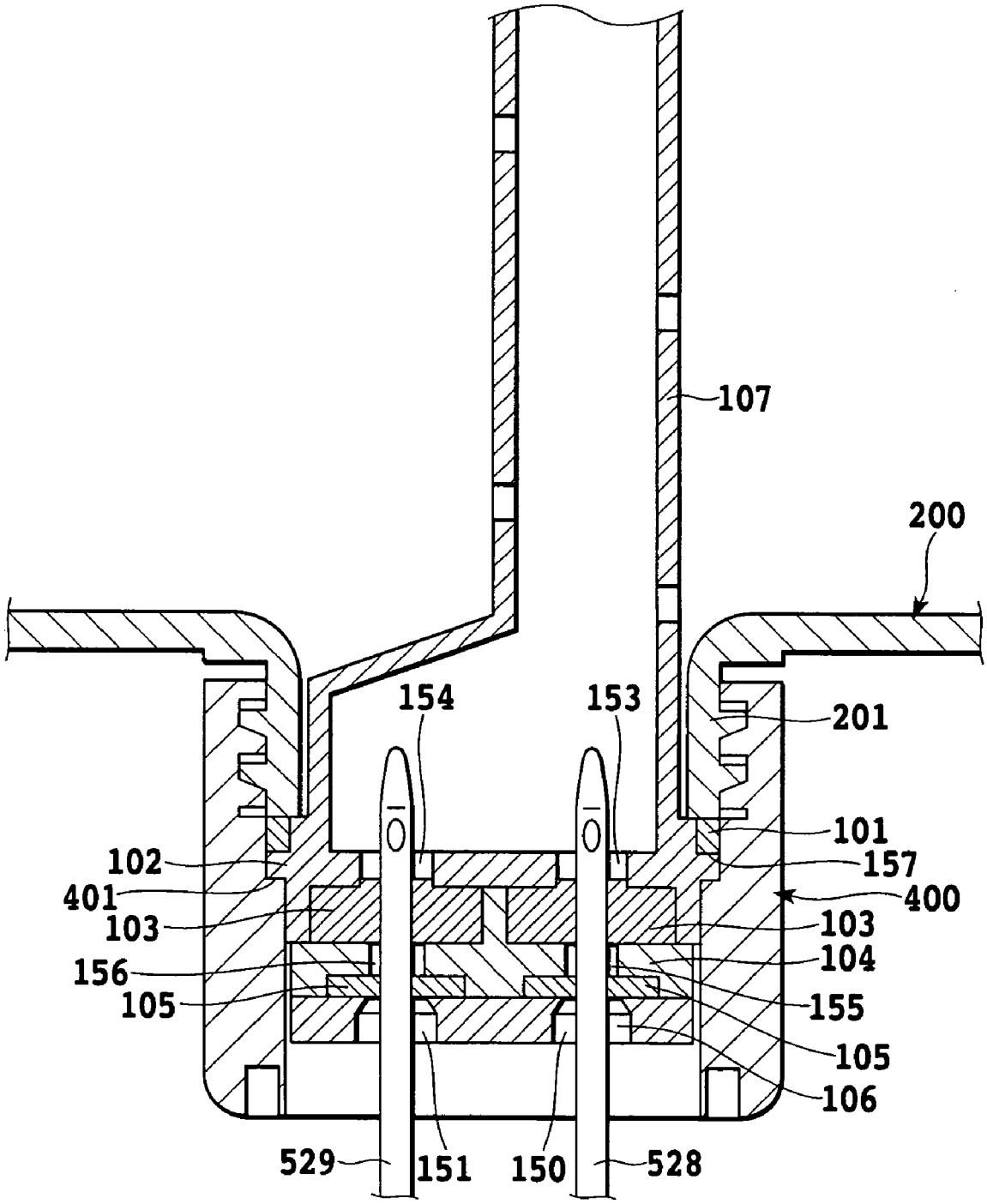
FIG. 4 is an enlarged cross-sectional view showing an ink supply portion of the connection unit.
Figure 5:
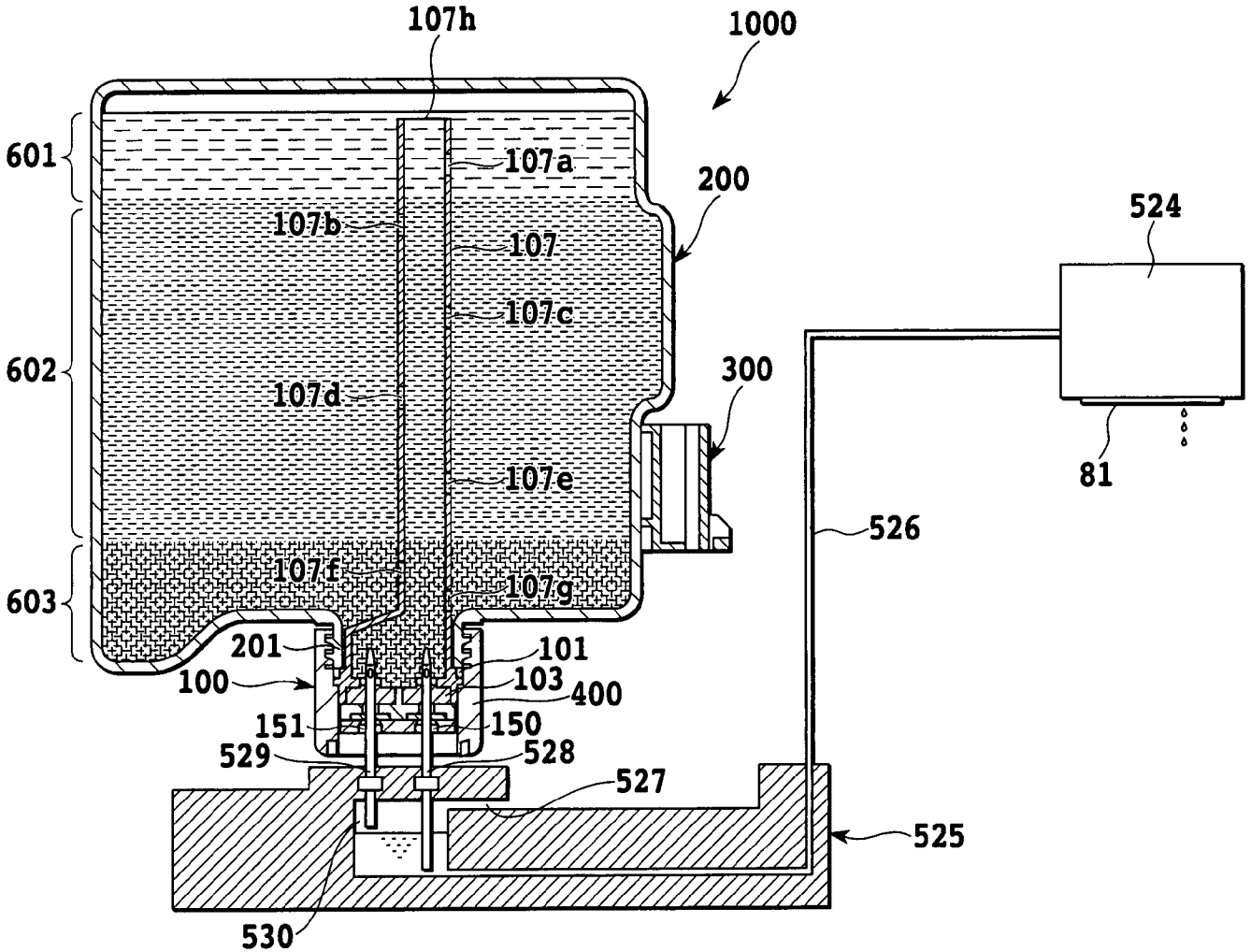
FIG. 5 is a schematic cross-sectional view showing the ink tank mounted on an ink jet printing apparatus.

FIG. 3 is an exploded perspective view of the connection unit and FIG. 4 is a schematic, enlarged cross section showing the connection ports and their associated components. FIG. 5 is a schematic cross section showing an ink tank mounted on an ink jet printing apparatus.

As shown in FIG. 5, the ink tank 1000 is mounted on an ink supply unit 525 provided in the ink jet printing apparatus. The ink supply unit 525 has a hollow ink supply needle 528 for extracting ink from the ink tank and a hollow air introducing needle 529 for introducing air into the ink tank. With these needles inserted into the connection ports 150, 151 in the connection unit 100 of the ink tank, the ink supply unit 525 communicates with the interior of the ink tank. Ink extracted through the ink supply needle 528 to the ink jet printing apparatus side is supplied to a print head 524 through an ink supply path 526. The print head 524 ejects ink onto a print medium not shown to perform a printing operation. The print head of this embodiment is of a serial type, which scans over the print medium in one direction while at the same time ejecting ink for printing. Then, a paper feed operation to feed the print medium a predetermined distance in a direction perpendicular to the scan direction of the print head is repetitively alternated with the print head scan operation to form an image over the entire print medium.

The print head 524 has a plurality of nozzles, in each of which an electrothermal transducer generates heat to form a bubble in ink whose pressure expels an ink droplet from the nozzle.

Figure 10:
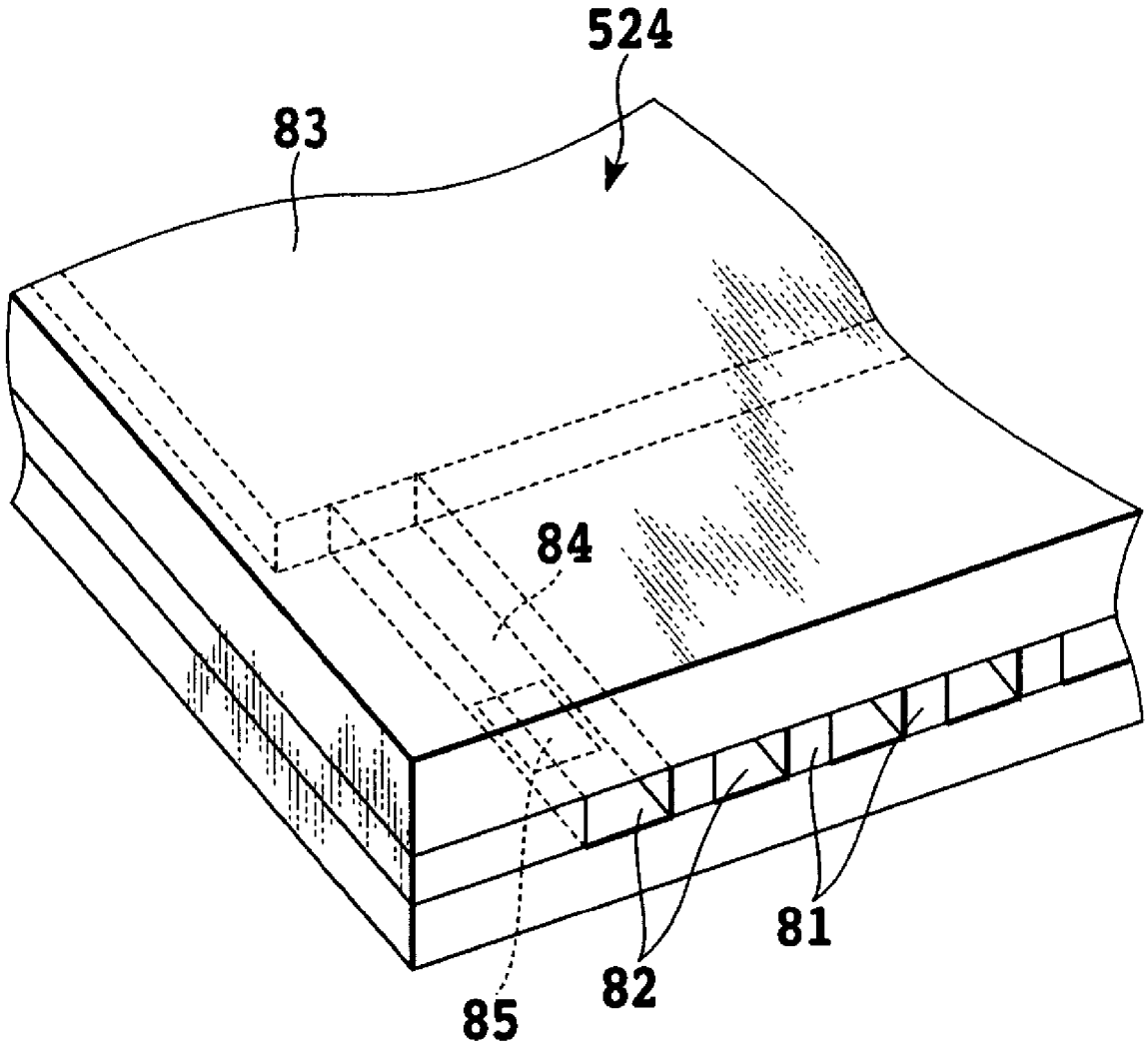
FIG. 10 is a perspective view showing nozzle openings in the print head.

FIG. 10 is a partial perspective view schematically showing a structure of ink ejection portions (nozzles) in the print head 524. An ejection face 81 opposing the print medium with a predetermined clearance (e.g., about 0.2 mm to 2.0 mm) therebetween is formed with a plurality of ejection ports 82 at a predetermined. pitch. An electrothermal transducer 85 for generating an ink ejection energy is installed along a wall surface of each liquid path 84 communicating a common liquid chamber 83 to each ejection port 82. The print head 524, based on an image signal or ejection signal, drives the corresponding electrothermal transducer 85 to film-boil the ink in the liquid path 84 to expel ink from the ejection port 82 by a pressure generated by boiling. While this embodiment employs a so-called bubble-through ejection method, the present invention is of course not limited to this method but may use other ejection methods such as a piezoelectric method.

The ink tank is installed in an ink jet printing apparatus of the above construction. The structure of the connection unit on the ink tank side and details of the ink supply needle and the air introducing needle will be explained.

The connection unit 100 has a plurality of connecting portions from the connection ports 150, 151 to the tubular member 107. The connecting portions have openings at positions corresponding to the connection ports 150, 151 to enable the tubular member 107 to communicate with the connection ports. Denoted 102 is a housing having communication holes 153, 154 at positions corresponding to the connection ports 150, 151. The housing 102 also has two recessed portions centered at these communication holes 153, 154 respectively. The recessed portions around the communication holes 153, 154 in the housing 102 are filled with two elastic members 103 formed of elastic material such as rubber. The elastic members 103 are each shaped like a dome, with their flat surfaces which are opposite the dome surface side fitted in the recessed portions of the housing 102. A pressing member 104 is secured to the housing 102 as by ultrasonic welding or locking claws (not shown), with the elastic members 103 held therebetween. That is, the pressing member 104 engages the dome side of the elastic members 103 and presses them against the housing 102, causing the elastic members 103 to radially expand, hermetically sealing the recessed portions in the housing 102. The pressing member 104 has communication holes 155, 156 at positions corresponding to the communication holes 153, 154 of the housing 102. The communication holes 155, 156 of the pressing member 104 are each fitted with an absorption body 105. An absorption body cover 106 with the connection ports 150, 151 is secured to the pressing member 104 or the housing 102 as by ultrasonic welding, locking claws (not shown) or fit in such a manner that the connection ports 150, 151 are aligned with the communication holes 155, 156 of the pressing member 104.

With the connection unit 100 assembled in this manner, an open end of the tubular member 107 which connects to the housing 102 encloses both of the connection ports 150, 151. That is, the tubular member 107 communicates with both of the connection ports 150, 151.

The connection unit 100 of the above construction is hermetically secured to the opening 201 of the ink storage portion 200 by screwing the internally threaded cap member 400 over the outer circumferential thread of the opening 201, with the seal member 101 held in between. A top surface of the cap member 400 is open so that, when the cap member 400 is secured to the ink storage portion 200, the absorption body cover 106 at the end of the connection unit 100 and its connection ports 150, 151 are exposed. Then, the seal member 101 is compressed a predetermined amount by the cap member 400 as it is screwed, thereby hermetically sealing the interior of the ink tank 1000 from outside. That is, the connection unit 100 and the cap member 400 are mounted to the ink storage portion 200 through the seal member 101 in a completely sealed state, so that ink will not leak from the mounting portion.

Next, the information storage unit 300 includes an information storage media holder 301, an information storage media 302 positioned and secured by a double-sided adhesive tape 303 to an inner surface of a recessed portion of the information storage media holder 301, and a comb-shaped ID unit (mechanical ID unit) having a plurality of projections 304.

The information storage media 302 exchanges information with the ink jet printing apparatus with the ink tank 1000 installed therein. Information exchanged between the information storage media 302 and the ink jet printing apparatus includes, for example, a time limit for ink usage and a volume and color of ink in the ink tank 1000. By retrieving such information from a control unit of the ink jet printing apparatus, an alarm can be issued to indicate that the time limit has been reached or ink has run out, prompting the user to replace the ink tank and thereby preventing adverse effects on a printed image which would otherwise be caused by ink color changes or increased ink viscosity. This can also prevent abnormal printing, which may be caused by an empty ink tank or by a wrong ink tank containing a wrong ink color being used. The provision of this information storage unit 300 ensures a proper printing operation at all times and therefore a high quality printed output.

The information storage media 302 may be of any type, such as flush memory or write-once magnetic media, as long as the media used allows retrieval of identification information by a variety of information retrieval means, magnetic, magneto-optical, electric or mechanical. In this embodiment, an electrically erasable and programmable EEPROM is used as a media which allows addition, modification and erasure of stored information from the ink jet printing apparatus side in addition to the retaining of ink tank identification information and the writing of information from the ink jet printing apparatus side. This EEPROM is mounted on a printed circuit board which has a contact portion electrically connected to an electric signal connector on the printing apparatus side. All these combine to form the information storage media 302.

The comb-shaped projections 304 are used as an ID for preventing an erroneous mounting of a wrong ink tank. According to an ink color or a type of the ink jet printing apparatus, a predetermined part of the comb teeth is cut off. On the ink tank mounting portion on the printing apparatus, a protrusion is provided at a position corresponding to the tooth cutoff position. So, only a tank whose comb tooth shape matches the protrusion on the printing apparatus side can be mounted. This prevents an erroneous mounting. Therefore, in addition to the erroneous mounting prevention by the information storage media, another erroneous mounting prevention is also provided by the mechanical structure.

Next, how the ink tank of the above construction is mounted on the ink jet printing apparatus will be explained.

As shown in FIG. 4, the ink supply needle 528 and the air introducing needle 529 on the ink jet printing apparatus side pierce through the connection ports 150, 151, the absorption body 105, the communication holes 155, 156, the elastic members 103 and the communication holes 153, 154 in the housing 102 and extend into the ink agitation chamber 107 to communicate with the interior of the ink storage portion 200 and extract ink. As the elastic members 103 are brought into intimate contact with the needles 528, 529, the ink in the ink storage portion 200 can be prevented from leaking outside. Further, when the needles 528, 529 are pulled out, the elastic members 103 by their own elastic force close the holes opened by the needles, so that an ink leakage is prevented when the ink tank is removed from the ink jet printing apparatus.

Returning to FIG. 5, the ink supply unit 525 has a buffer chamber 530 to store the ink extracted through the ink supply needle 528. The ink supply needle 528 extends to near a bottom of the buffer chamber 530 so that a lower end of the needle opposite an upper end inserted in the ink tank 1000 is always submerged in the ink stored in the buffer chamber 530. The air introducing needle 529 extends to a vertically intermediate position in the buffer chamber 530. In a normal state, an ink level in the buffer chamber 530 is lower than a lower end of the air introducing needle 529 extending into the buffer chamber 530.

The print head 524 ejects ink from the ejection face 81 onto a print medium to form a printed image. Then, to make up for the ink ejected, the ink in the buffer chamber 530 is supplied to the print head 524 through the ink supply path 526. As the ink volume in the ink storage portion 200 decreases as a result of supplying ink to the print head, the pressure in the ink storage portion 200 lowers. This in turn causes the air, that has been introduced into the buffer chamber 530 from an air communication portion 527 provided in the ink supply unit 525, to flow into the ink agitation chamber 107 through the air introducing needle 529.

Here, on the ink jet printing apparatus side, the ink supplied to the print head 524 needs to be kept at a predetermined negative pressure. In this embodiment, since the lower end 529*a* of the air introducing needle 529 for introducing air into the ink tank is situated vertically lower than the ejection face 81 of the print head 524, a height difference (water head difference h) between the lower end 529*a* and the ejection face 81 always acts as a negative pressure on the ejection ports 82 of the print head 524. That is, irrespective of the height of the ink level in the ink tank 1000, an almost constant negative pressure acts on the ejection ports 82 of the print head 524 at all times.

When the air in the ink storage portion 200 expands due to environmental changes such as temperature or atmospheric pressure changes, the ink is pushed out into the buffer chamber 530 through the air introducing needle 529. The buffer chamber 530, however, has a large enough space to keep the ink from overflowing from the buffer chamber 530. Even if a small amount of ink should overflow from this buffer chamber 530, the spilt ink is absorbed by a waste ink absorber (not shown) provided at an end of the air communication portion 527 in the buffer chamber, protecting other portions in the printing apparatus against being smeared with ink. Conversely, when the air in the ink storage portion 200 contracts due to environmental changes, air is introduced through the hollow air introducing needle 529 into the ink storage portion 200.

While in this embodiment, the construction has been shown which introduces air from the air introducing needle 529 to compensate for a pressure reduction in the ink storage portion 200 as a result of ink supply to the print head 524, another method may also be employed which involves connecting to the second connection port (connection port for introducing air) 151 of the connection unit 100 a system that supplies ink under a constant pressure and then supplying ink to make up for a pressure reduction. In this case, the ink supplied to make up for a pressure reduction may be the same kind of liquid as the ink contained in the ink storage portion 200.

As shown in FIG. 5, the ink agitation chamber 107 extends in the height direction of the ink storage portion 200 and has supply holes 107*a*–107*h* almost evenly spaced apart vertically over a range from a top to a bottom thereof. Through these supply holes the ink is introduced.

The ink contained in the ink tank 1000 is a pigment ink using a pigment as a colorant, so that a precipitation of the pigment causes the ink concentration to increase toward the bottom of the tank. In this embodiment, for the sake of simplicity in explanation the ink in the ink tank is divided into three layers: a high pigment concentration layer 603, an intermediate pigment concentration layer 602 and a low pigment concentration layer 601. In each of these layers, it is needless to say that the ink concentration increases toward the bottom of the ink tank. Since the supply holes 107*a*–107*h* of the ink agitation chamber 107 are distributed evenly in the longitudinal direction of the chamber 107, inks from the different concentration layers 601–603 are introduced. The inks thus introduced into the ink agitation chamber 107 are temporarily stored there and mixed.

When the ink is supplied to the print head 524, air is introduced into the ink agitation chamber 107 through the air introducing needle 529, as described above.

Figure 6:
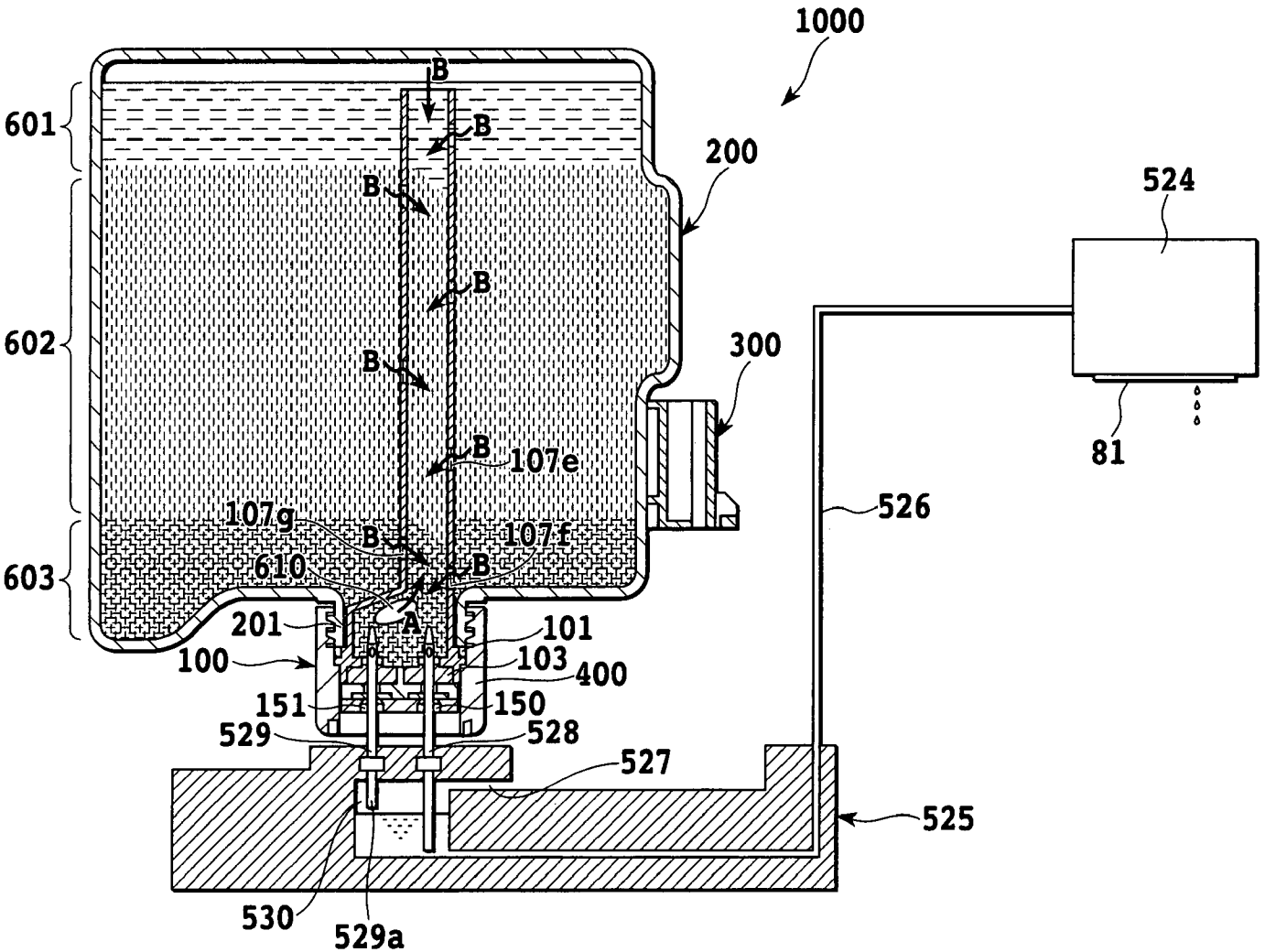
FIG. 6 is a schematic cross-sectional view of the ink tank showing a bubble introduced into an ink agitation chamber.

As shown in FIG. 6, the air thus introduced moves up as a bubble 610 toward the top of the ink tank along an arrow A. The inks flow in from the supply holes 107*a*–107*h* in directions of arrow B. Since the directions in which the inks flow in (arrow B) and the direction in which the bubble 610 rises (arrow B) are opposite, the bubble 610 promotes an agitation of the inks as it rises, thus dispersing and evenly distributing the pigments.

Figure 7:
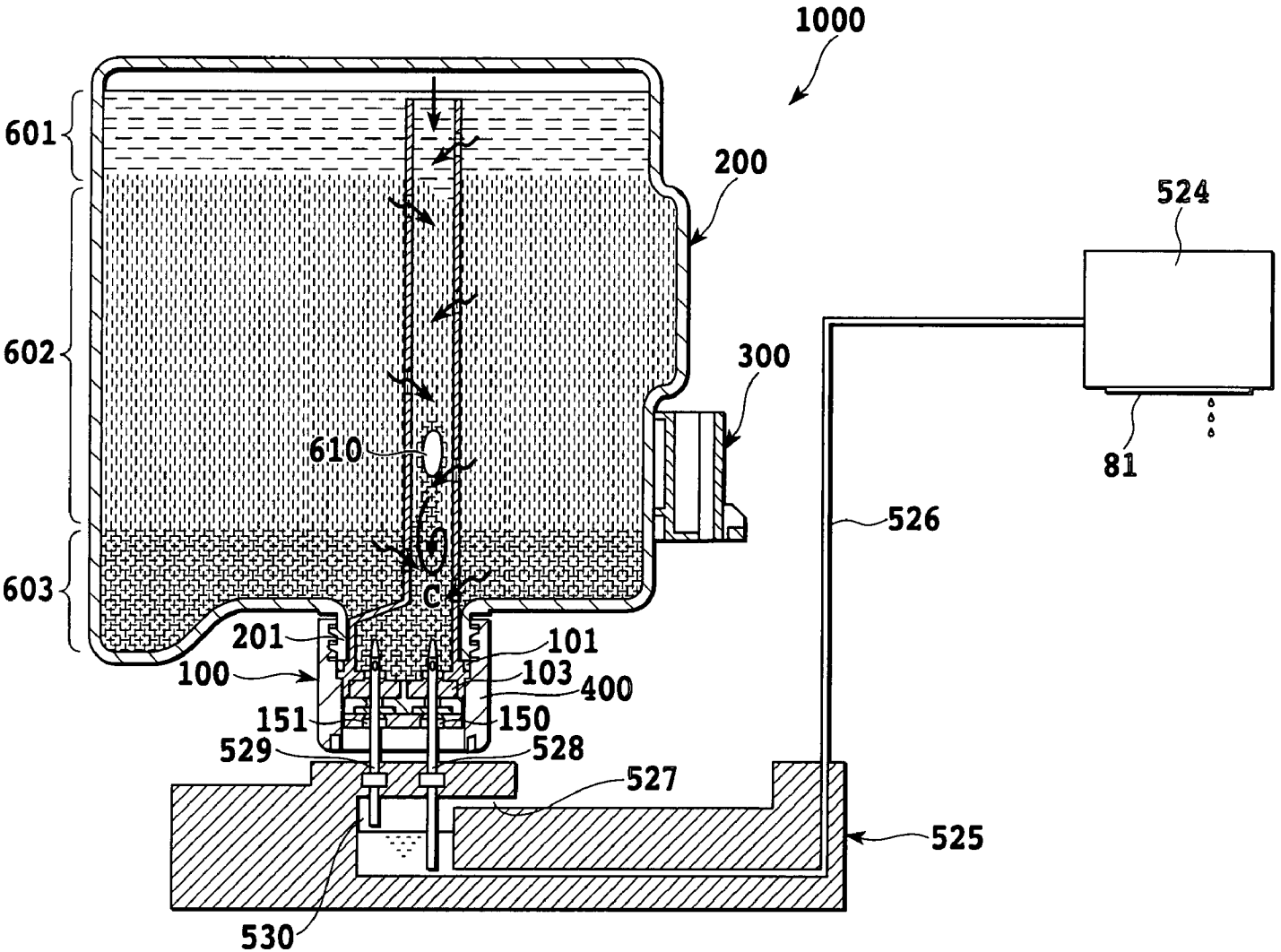
FIG. 7 is a schematic cross-sectional view of the ink tank showing the bubble rising in the ink agitation chamber.

FIG. 7 shows a bubble that has risen to the intermediate pigment concentration layer 602.

The weight of a predetermined volume of ink increases as the pigment concentration increases, so that in an unagitated state the inks drawn in from the intermediate and low concentration layers, which are lighter than the high concentration layer, will not come below the ink drawn in from the high concentration layer. However, as the bubble 610 rises, the inks in the ink agitation chamber 107 are disturbed pushing the ink of the high concentration layer above the ink of the intermediate concentration layer. After having been pushed up, the ink of the high concentration layer tends to sink by its own gravity, generating a convection C between the different concentration layers and mixing these inks. This mixing action results in a further diffusion of the pigments.

Figure 8:
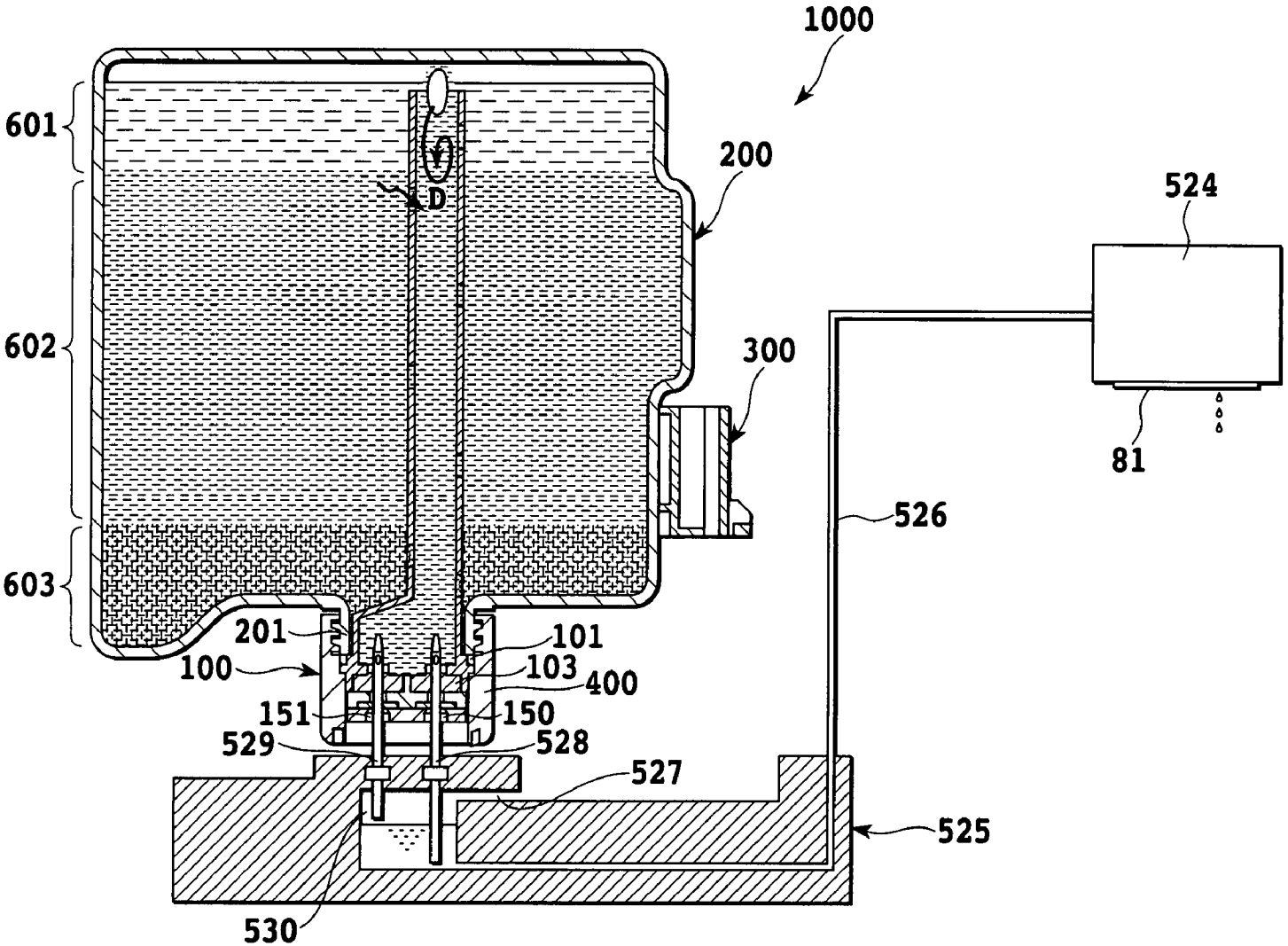
FIG. 8 is a schematic cross-sectional view of the ink tank showing the bubble being discharged from the ink agitation chamber.

Then, as the bubble 610 rises further up, as shown in FIG. 8, the ink of the intermediate concentration layer is pushed up into the low concentration layer, generating a similar convection D, agitating inks. Here, at least one of the supply holes in the ink agitation chamber 107 needs to be set roughly as large as will allow the bubble 610 introduced from the air introducing needle 529 to move from the ink agitation chamber 107 out into the ink storage portion 200. In this embodiment, the supply hole 107*h* has a slightly larger diameter than other supply holes. By setting at least one of the supply holes to a size large enough for the bubble 610 to pass through, it is possible to eliminate a problem that the air, unable to escape from the ink agitation chamber 107, may fill the ink agitation chamber 107 and thereby interfere with a normal supply of ink.

Introducing the bubble 610 into the ink agitation chamber 107 as described above can diffuse precipitated pigments in the ink agitation chamber 107, making the ink concentration in the chamber uniform. Thus, there is no need to suck out ink from the ink agitation chamber 107 for periodic discarding outside and the print head can be supplied ink of uniform concentration at all times.

(Embodiment 2)

In this embodiment, we focus on the supply holes formed in the ink agitation chamber. The structure of the ink tank of this embodiment is similar to that of Embodiment 1 except for the supply holes in the ink agitation chamber.

Figure 9A:
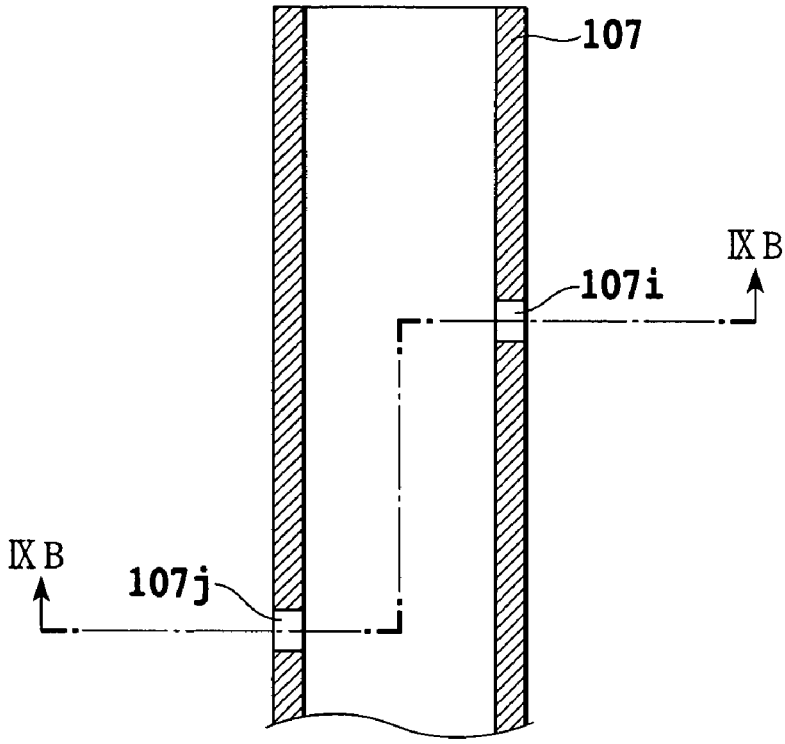
FIG. 9A is a longitudinal cross-sectional view showing a part of an ink agitation chamber in a second embodiment.

FIG. 9A is an enlarged, longitudinal cross-sectional view showing a part of an ink agitation chamber of this embodiment.

Figure 9B:
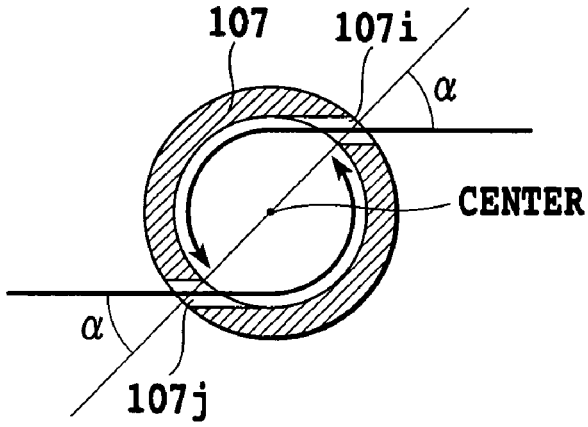
FIG. 9B is a radial cross-sectional view taken along the line IXB—IXB of FIG. 9A.

FIG. 9B is a cross section taken along the line IXB—IXB of FIG. 9A.

In this embodiment, the supply holes in the ink agitation chamber 107 are arranged in staggered format so that there are no two supply holes at the same height. Further, as the radial cross section shows, two supply holes 107*i*, 107*j* formed in opposing surfaces open not perpendicular to the surfaces but at an angle α. That is, the supply holes 107*i*, 107*j* do not open toward the radial center but in directions shifted by an angle α from the center line. Therefore, the inks introduced from the supply holes 107*i*, 107*j* flow in the ink agitation chamber 107 as indicated by arrows to form a vortex, rendering their flow more complex and producing a higher agitation effect. Further, although the use of independent, arbitrary opening angles for individual supply holes can produce the similar effect to some degree, the convection is more effectively generated by setting the opening angles of the supply holes to the same angle α with respect to the center, as in this embodiment.

(Embodiment 3)

In this embodiment, a construction is described in which an ink tank is formed flat to save an installation space.

Figure 11:
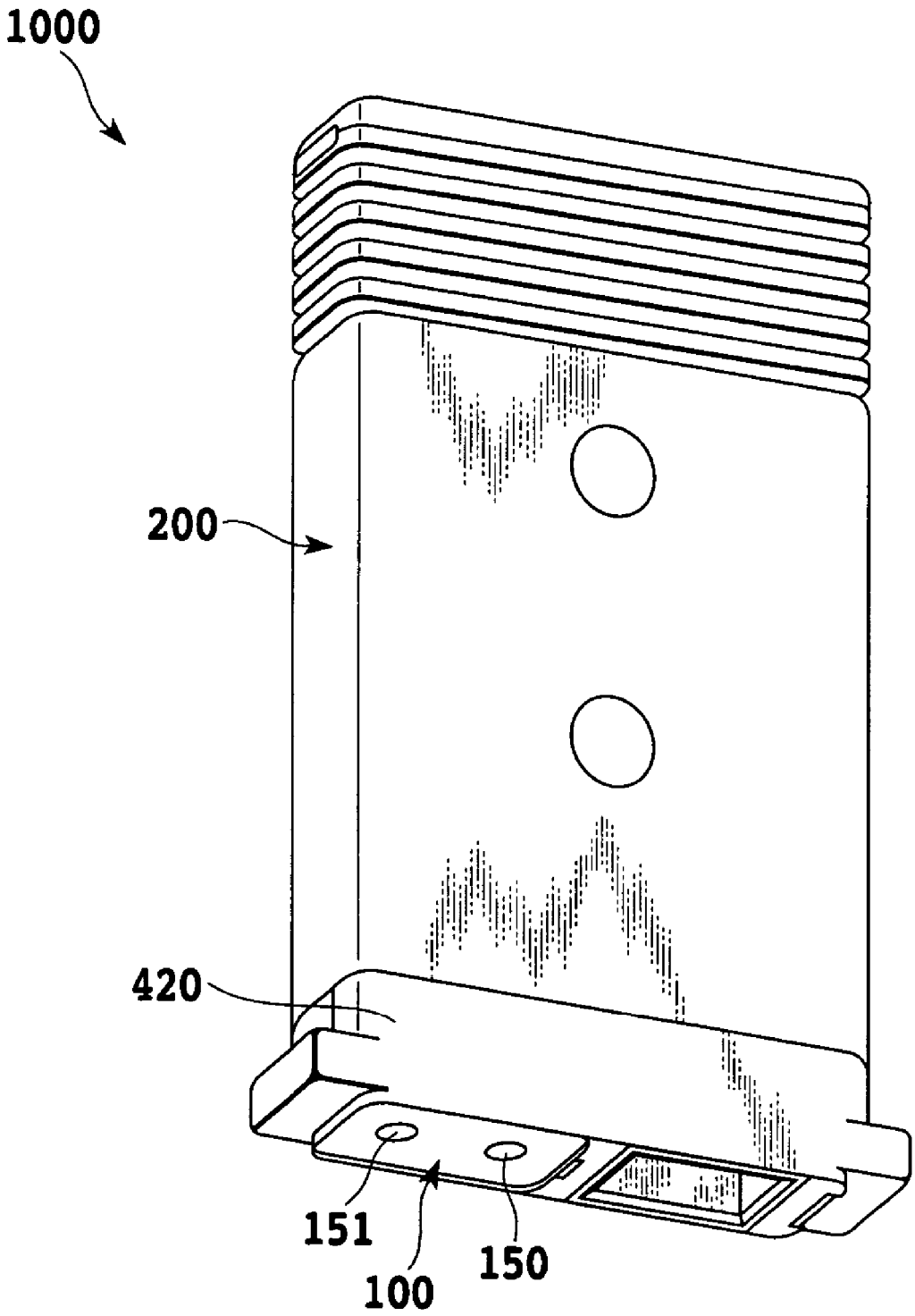
FIG. 11 is a perspective view showing an ink tank in a third embodiment.

FIG. 11 is a schematic perspective view of an ink tank of this embodiment.

An ink storage portion 200 is a hollow container formed of a plastic material by blow molding, as in Embodiment 1 and 2, and is characterized by a flat configuration with a reduced tank width.

A connection unit 100 has connection ports 150, 151 as in Embodiment 1–3 but in this embodiment is rigidly secured by a guard member 420 covering an entire bottom portion of the ink storage portion 200. That is, while in Embodiment 1–3 the portion to which the connection unit 100 is mounted protrudes, it is covered by the guard member 420 in this embodiment, making the overall ink tank look like a box.

Figure 12:
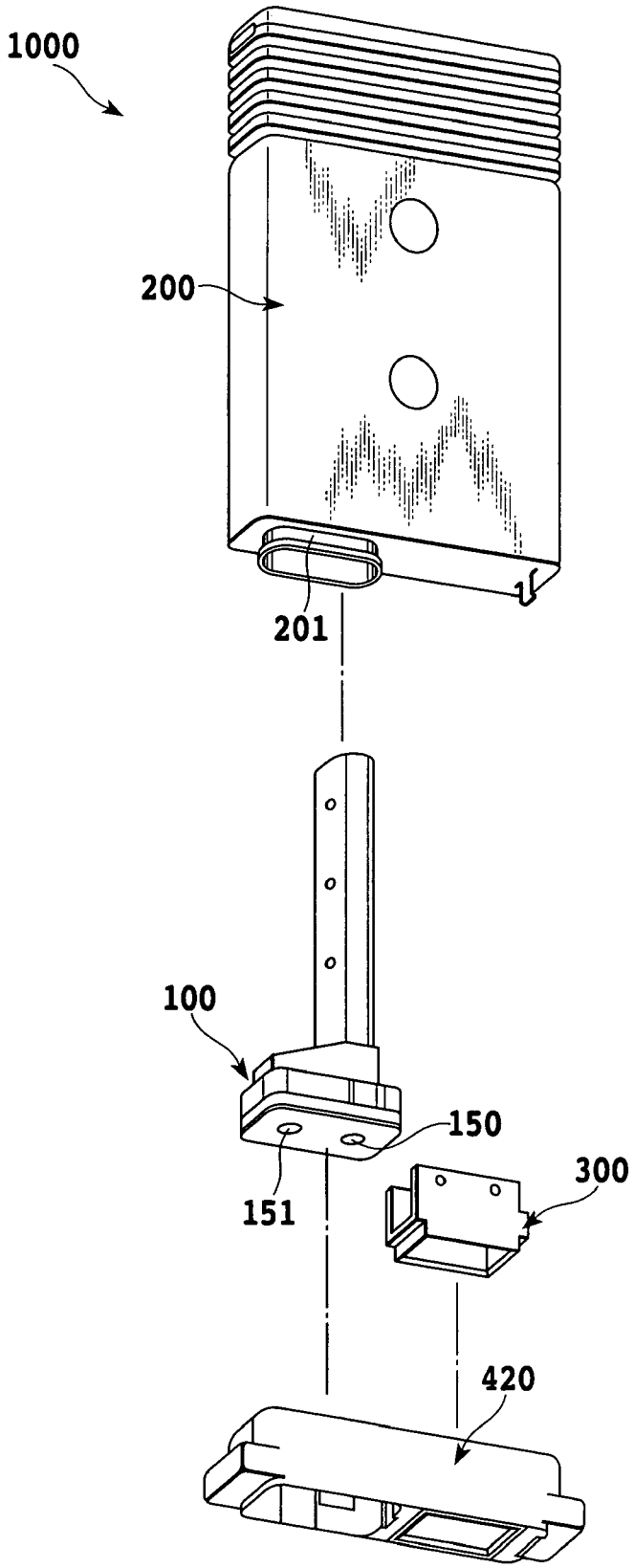
FIG. 12 is an exploded perspective view showing the ink tank of FIG. 11.

FIG. 12 is an exploded perspective view of the ink tank removed of the guard member.

Figure 13:
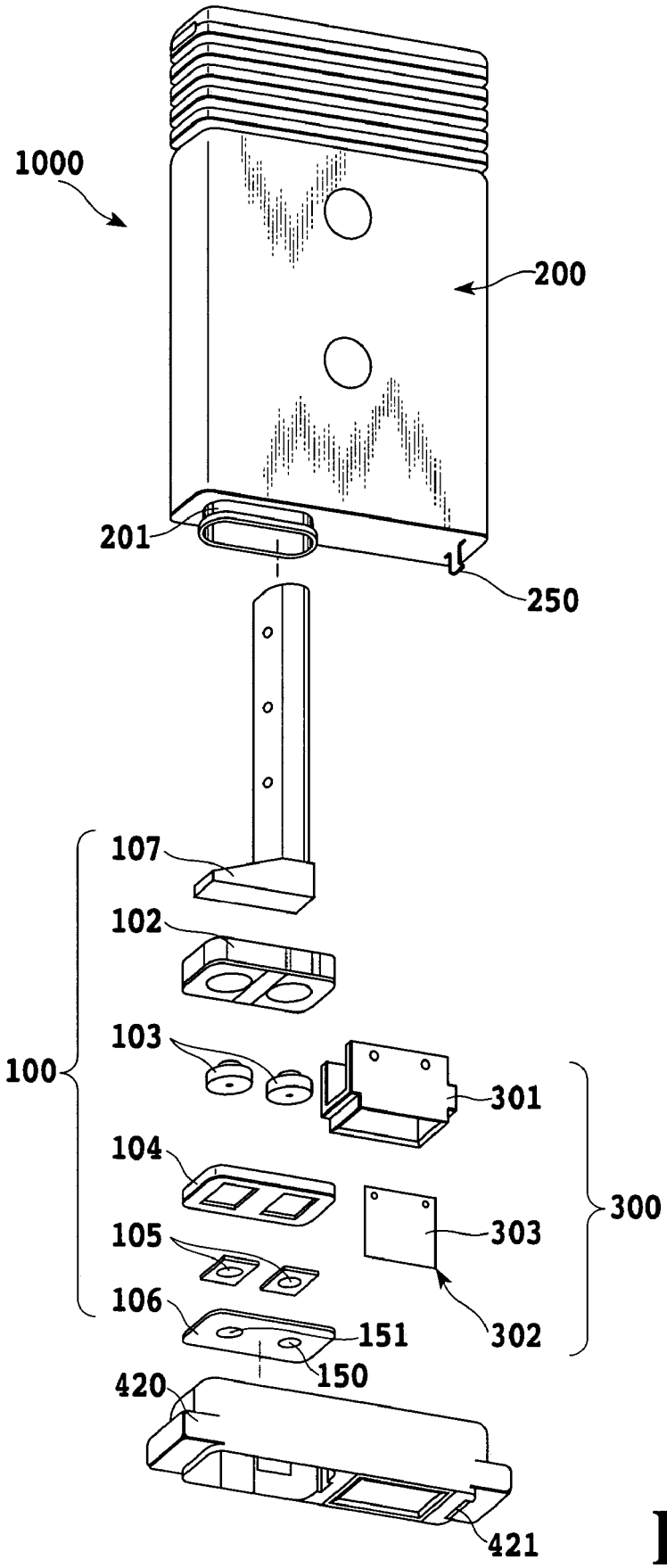
FIG. 13 is an exploded perspective view showing a connection unit of FIG. 12 in a further disassembled state.

FIG. 13 is a perspective view of the ink tank with the connection unit disassembled.

The connection unit 100 has an ink agitation chamber 107 and a plurality of connecting portions. The connecting portions are each provided with communication holes at positions corresponding to the connection ports. The connecting portions comprise: a housing 102; two elastic members 103 made of a rubber elastic material fitted in two recessed portions formed near two communication holes in the housing 102; a pressing member 104 having communication holes at positions corresponding to the elastic members 103; absorption bodies 105 arranged near the communication holes of the pressing member 104; and an absorption body cover 106 fitted to the outside of the absorption body. These are secured together integrally as by ultrasonic welding, as in Embodiment 1 and 2.

As in Embodiment 1 and 2, the ink agitation chamber 107 is secured to the housing 102 by ultrasonic welding or locking claws. The elastic members 103 are each shaped like a dome and compressed and fixed in the housing 102 by the pressing member 104. The two absorption bodies 105 fitted in the pressing member 104 are held by the absorption body cover 106. The absorption body cover 106 is secured to the pressing member 104 or the housing 102 by ultrasonic welding or locking claws. These components are assembled into the integral connection unit in this manner. This connection unit has its housing secured to the opening 201 of the ink storage portion 200 by ultrasonic welding.

On a plane on which the connection ports of the connection unit 100 for the ink storage portion are situated, an information storage unit 300 is arranged adjacent to the connection unit. The guard member 420 is secured to a bottom part of the ink storage portion 200 to cover both of the connection unit 100 and the information storage unit 300. The fixing of the guard member 420 to the ink storage portion 200 is accomplished by a latch mechanism, which has a flexible hook 250 provided on the ink storage portion 200 inserted into a locking hole 421 of the guard member 420 to engage a claw of the hook with an edge of the locking hole 421 by taking advantage of a reactionary force of the hook as it is inserted and radially expanded. While this embodiment uses a hook in securing the guard member 420, other fixing means may be employed.

The guard member 420 are open at portions corresponding to the connection ports 150, 151 of the connection unit 100 and the information storage unit 300 but as a whole covers the connection unit 100 and the information storage unit 300 to protect them against external impacts.

At one longitudinal end the guard member 420 has a mechanical ID formed of comb-shaped projections to prevent an unintended mounting of a wrong ink tank.

An ink supply mechanism, as in Embodiment 1 and 2, supplies ink, drawn into the ink agitation chamber from its supply holes, to the print head through an ink supply needle inserted into the connection port. Since the ink storage portion is formed of a flat container, when a plurality of ink tanks are to be mounted to the printing apparatus, only a small mounting space is required on the printing apparatus side. This in turn reduces the size of the printing apparatus itself.

Further, since the connection unit 100 is secured to the ink storage portion as by ultrasonic welding, members equivalent to a seal member and a cap member can be omitted, contributing to a more simplified structure and a reduction in parts count.

Further, the guard member is secured to the ink storage portion by the latch mechanism to protect and hold the connection unit and the information storage unit. The guard member also has a mechanical ID for erroneous mounting prevention and still retains a simple external contour.

While in Embodiment 3 two connection ports 150, 151 are provided in the connection unit 100, this invention may use any number of connection ports as long as they ensure a proper ink supply and air introduction. For example, only one connection port may be provided which allows both of the ink supply needle and the air introducing needle to be inserted therein. It is also possible to provide three or more connection ports, at least one of which may have the air introducing needle inserted therethrough.

Further, while in Embodiment 1–3 the ink agitation chamber is formed cylindrical, this invention may use a square or triangular or any other polygonal pillar. The ink agitation chamber can take any desired shape depending on how ink is drawn in.

Further, although Embodiment 1–3 have been described for an example case of a pigment ink tank mounted on an ink jet printing apparatus, the present invention is not limited to this type of ink tank and applies to all types of liquid container that store a liquid whose concentration varies according to a position inside the container in a static state. The only requirement is that the liquid container have, in addition to the liquid supply path, an air introducing path to introduce air according to the state in which the liquid is being supplied from the container to a separate device.

As described above, with this invention, as the air introduced into the tubular member through an air introducing port rises as a bubble in the tubular member, a convection is generated in the liquid in the tubular member to disturb it, so that concentration variations in the liquid inside the tubular member are alleviated, making it possible to supply a liquid of a predetermined concentration from a supply port. Therefore, when a liquid is extracted from a liquid container containing a plurality of different concentration layers in a static state, the concentration variations of the extracted liquid can be eliminated, making the concentration of the liquid being supplied constant at all times.

Further, by forming liquid supply holes in the tubular member at a predetermined angle to the center of the tubular member, it is possible to make the convection inside the tubular member more complex and agitate the inside liquid more greatly, further alleviating the concentration variations.

Further, by forming a case of the liquid container in a flat shape, the container mounting space on the printing apparatus side can be reduced.

The present invention has been described in detail with respect to preferred embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. A liquid container storing a liquid that forms a plurality of concentration layers in a static state and having a supply port for supplying the liquid to another device, the liquid container comprising:

a hollow tubular member whose one end installed in the liquid container is connected to the supply port, wherein the tubular member extends vertically upward from a bottom of the liquid container to a height almost equal to an inner height of the liquid container;

plural liquid supply holes formed in the tubular member at a plurality of vertically spaced locations, wherein each of the plural liquid supply holes introduces nearby liquid into the tubular member; and an air introducing port provided at a bottom of the tubular member to introduce air into the tubular member, wherein said air introducing port and said supply port are both located at a bottom of said hollow tubular member;

wherein the liquid in the liquid container is introduced into the tubular member through the plural liquid supply holes and the liquid thus introduced is supplied from the supply port to another device, and the air introduced into the tubular member through the air introducing port rises as a bubble in the tubular member to agitate the liquid inside the tubular member.

2. A liquid container as claimed in claim 1, wherein at least one of the plural liquid supply holes is as large as will allow the bubble introduced from the air introducing port to move therethrough out of the tubular member.

3. A liquid container as claimed in claim 1, wherein at least one of the plural liquid supply holes are open in the tubular member in a direction at a predetermined angle to a center axis of the tubular member.

4. A liquid container as claimed in claim 3, wherein the plural liquid supply holes are all open at the same angle to the center axis of the tubular member.

5. A liquid container as claimed in claim 1, wherein the tubular member, the supply port and the air introducing port combine to form an integral connection unit removable from the liquid container body.

6. A liquid container as claimed in claim 1, wherein the liquid is a pigment ink.

* * * * *